US010906764B2

(12) United States Patent
Yoneyama et al.

(10) Patent No.: US 10,906,764 B2
(45) Date of Patent: Feb. 2, 2021

(54) PRINTING APPARATUS AND STORAGE APPARATUS

(71) Applicant: CANON KABUSHIKI KAISHA, Tokyo (JP)

(72) Inventors: Hiromasa Yoneyama, Chigasaki (JP); Yasuyuki Asai, Tokyo (JP); Tetsuo Kikuchi, Ayase (JP); Itaru Wada, Yokohama (JP); Daiki Anayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 362 days.

(21) Appl. No.: 15/965,124

(22) Filed: Apr. 27, 2018

(65) Prior Publication Data

US 2018/0327210 A1 Nov. 15, 2018

(30) Foreign Application Priority Data

May 12, 2017 (JP) ..... 2017-095396

(51) Int. Cl.
*B65H 23/26* (2006.01)
*B65H 16/10* (2006.01)
(Continued)

(52) U.S. Cl.
CPC ..... *B65H 23/26* (2013.01); *B41J 13/106* (2013.01); *B65H 16/028* (2013.01); *B65H 16/10* (2013.01);
(Continued)

(58) Field of Classification Search
CPC ..... B65H 23/26; B65H 16/028; B65H 23/28; B65H 35/08; B65H 16/10; B65H 2301/448; B65H 2801/06; B41J 13/106
See application file for complete search history.

(56) References Cited

U.S. PATENT DOCUMENTS 6,568,865 B1 * 5/2003 Fujioka ..... B65H 31/02 271/207
9,096,401 B2 * 8/2015 Ueyama ..... B41J 11/001
(Continued)

FOREIGN PATENT DOCUMENTS

JP 62-77966 A 4/1987
JP 2006-240846 A 9/2006
(Continued)

OTHER PUBLICATIONS

Office Action dated Oct. 29, 2019, in Japanese Patent Application No. 2017-095396.
(Continued)

*Primary Examiner* — William A. Rivera
(74) *Attorney, Agent, or Firm* — Venable LLP

(57) ABSTRACT

A printing apparatus is capable of preventing a sheet discharged from a discharge unit from entering a feeding unit while guiding the sheet properly to a storage unit located below the feeding unit. The printing apparatus includes a storage unit configured to store a sheet discharged from a discharge unit and a guide unit configured to guide the sheet discharged from the discharge unit to the storage unit. The guide unit has a turning unit which prevents the sheet discharged from the discharge unit from entering a feeding unit and which turns when the sheet comes into contact with the turning unit.

19 Claims, 13 Drawing Sheets

(51) Int. Cl.

| | |
|---|---|
| ***B41J 13/10*** | (2006.01) |
| ***B65H 16/02*** | (2006.01) |
| ***B65H 23/28*** | (2006.01) |
| ***B65H 35/08*** | (2006.01) |

(52) U.S. Cl.
CPC ..... *B65H 23/28* (2013.01); *B65H 35/08* (2013.01); *B65H 2301/448* (2013.01); *B65H 2801/06* (2013.01)

(56) References Cited

U.S. PATENT DOCUMENTS

| | | | | |
|---|---|---|---|---|
| 9,272,872 | B2 | 3/2016 | Sugiyama et al. | |
| 9,434,189 | B2 | 9/2016 | Anayama et al. | |
| 9,579,907 | B2 | 2/2017 | Shinjo et al. | |
| 9,580,268 | B2 | 2/2017 | Nagashima et al. | |
| 9,592,683 | B2 | 3/2017 | Kobayashi et al. | |
| 2001/0046405 | A1* | 11/2001 | Miyazaki | B41J 15/042 400/605 |
| 2013/0286125 | A1* | 10/2013 | Mikuriya | B41J 13/106 347/104 |
| 2013/0306784 | A1* | 11/2013 | Ueyama | B41J 11/001 242/560 |
| 2014/0292980 | A1* | 10/2014 | Horie | B65H 31/20 347/104 |
| 2015/0273893 | A1* | 10/2015 | Kudo | B41J 3/60 347/16 |
| 2015/0273897 | A1* | 10/2015 | Kato | B41J 13/106 347/104 |
| 2017/0088384 | A1* | 3/2017 | Asai | B41J 15/04 |
| 2017/0120636 | A1 | 5/2017 | Kobayashi et al. | |

FOREIGN PATENT DOCUMENTS

| | | | |
|---|---|---|---|
| JP | 2010-215367 | * | 9/2010 |
| JP | 2014-104630 | A | 6/2014 |
| JP | 2016-097527 | A | 5/2016 |

OTHER PUBLICATIONS

Office Action dated Apr. 2, 2019, in Japanese Patent Application No. 2017-095396.

U.S. Appl. No. 15/891,748, Takakazu Ohashi Daiki Anayama Hiromasa Yoneyama Yasuyuki Asai Takuya Suto Tetsuo Kikuchi Itaru Wada, filed Feb. 8, 2018.

U.S. Appl. No. 15/896,504, Hiromasa Yoneyama Daiki Anayama Yasuyuki Asai Tetsuo Kikuchi, filed Feb. 14, 2018.

U.S. Appl. No. 15/960,961, Yasuyuki Asai Hiromasa Yoneyama Tetsuo Kikuchi Itaru Wada Daiki Anayama, filed Apr. 24, 2018.

* cited by examiner

PRINTING APPARATUS AND STORAGE APPARATUS

BACKGROUND OF THE INVENTION

Field of the Invention

The present invention relates to a printing apparatus including a storage unit for storing a sheet discharged from a discharge unit and a storage apparatus for storing the sheet.

Description of the Related Art

Japanese Patent Laid-Open No. 2016-097527 discloses a printing apparatus in which a feeding unit for delivering a sheet from a roll formed by winding a continuous sheet to a printing unit can also be used for a winding unit for winding the sheet discharged from the printing unit. This printing apparatus includes guide unit capable of switching whether to guide a discharged printed object to a storage unit or to the feeding unit.

In the configuration disclosed in Japanese Patent Laid-Open No. 2016-097527, when the discharged printed object is guided to the storage unit, the guide unit is fixedly held at certain switching positions to prevent the sheet from entering the feeding unit. With this configuration, in the case where the printed object is strongly curled, the curled printed object sometimes comes into contact with the guide unit and closes the sheet guide path toward the storage unit. In this case, there arise problems that the printed object, closing the guide path, itself is not properly stored in the storage unit, and also that the subsequent printed objects cannot be stored in the storage unit. As a solution to these problems, it is conceivable to widen the guide path to the storage unit, but this causes another problem that the apparatus becomes larger.

SUMMARY OF THE INVENTION

An object of the present invention is to provide a printing apparatus and storage apparatus capable of preventing a sheet discharged from a discharge unit from entering a feeding unit while guiding the sheet properly to a storage unit located below the feeding unit.

A printing apparatus according to the present invention includes: a feeding unit to feed a sheet; a printing unit to perform printing on the sheet fed from the feeding unit; a discharge unit to discharge the sheet, on which the printing has been performed by the printing unit, from above the feeding unit; a storage unit arranged below the feeding unit and configured to store the sheet discharged from the discharge unit; and a guide unit to guide the sheet discharged from the discharge unit toward the storage unit, and the guide unit has a turning unit which prevents the sheet discharged from the discharge unit from entering the feeding unit and which turns when the sheet comes into contact with the turning unit.

The present invention makes it possible to prevent a sheet discharged from a discharge unit from entering a feeding unit while guiding the sheet properly to a storage unit located below the feeding unit.

Further features of the present invention will become apparent from the following description of exemplary embodiments with reference to the attached drawings.

DESCRIPTION OF THE EMBODIMENTS

First Embodiment

Figure 1A:
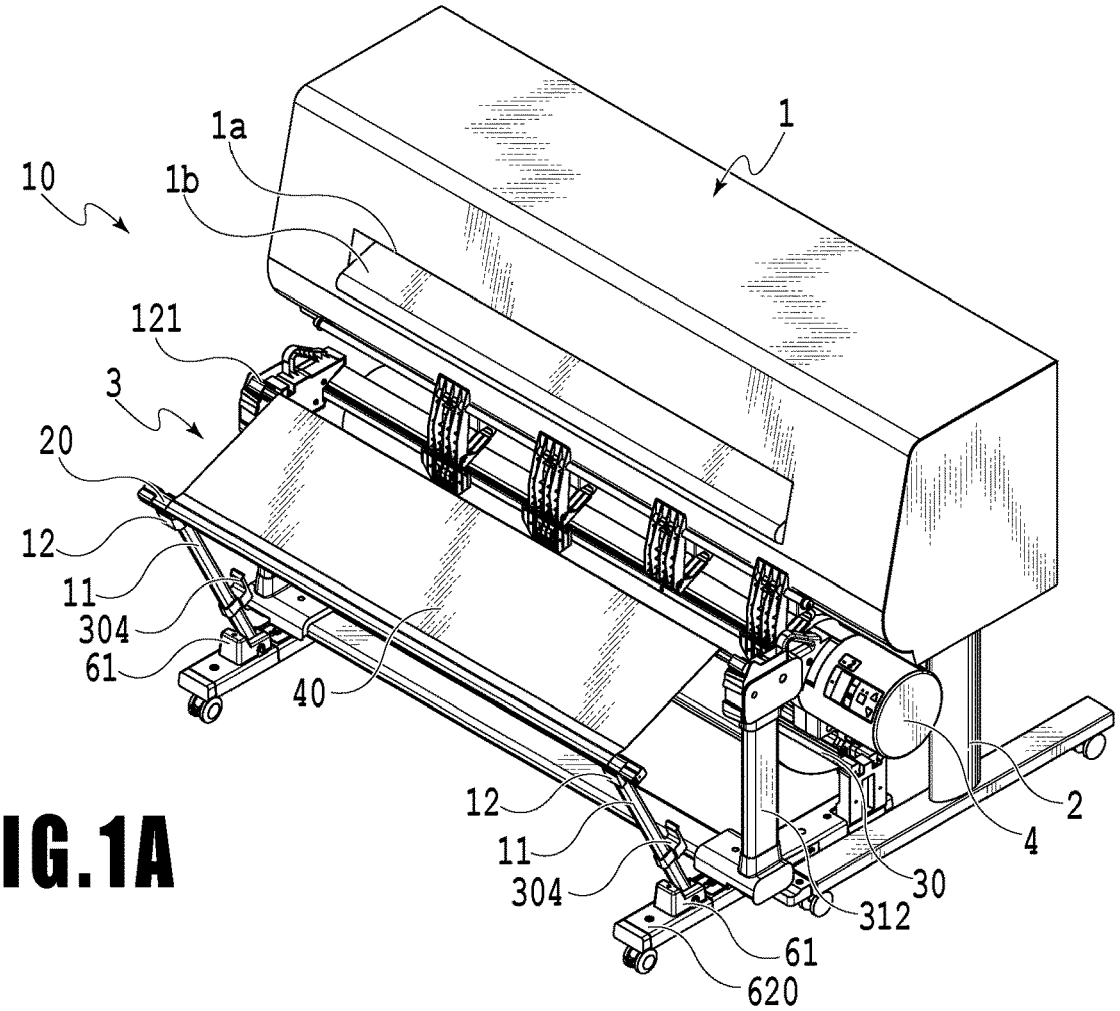
FIG. 1A is a perspective view illustrating a printing apparatus according to the present embodiments.
Figure 1B:
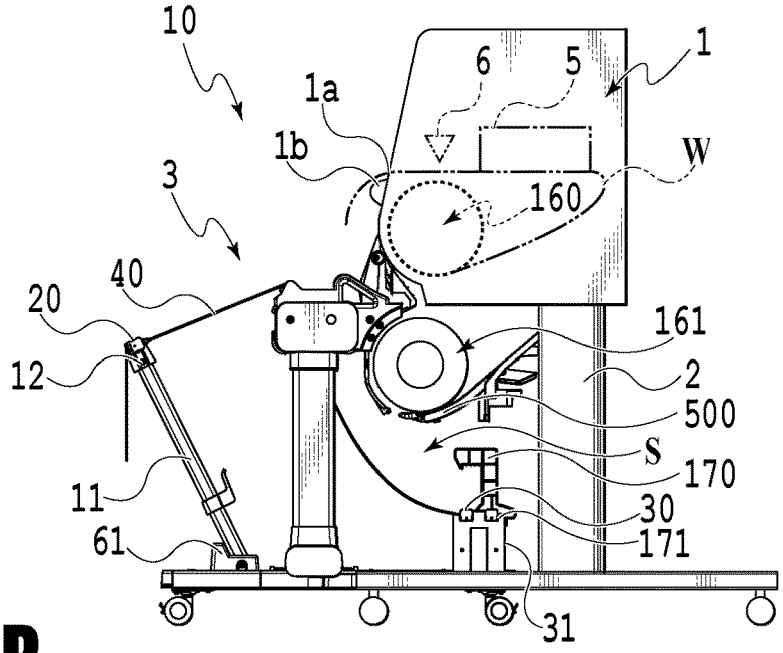
FIG. 1B is a side view illustrating the printing apparatus according to the present embodiments.
Figure 2:
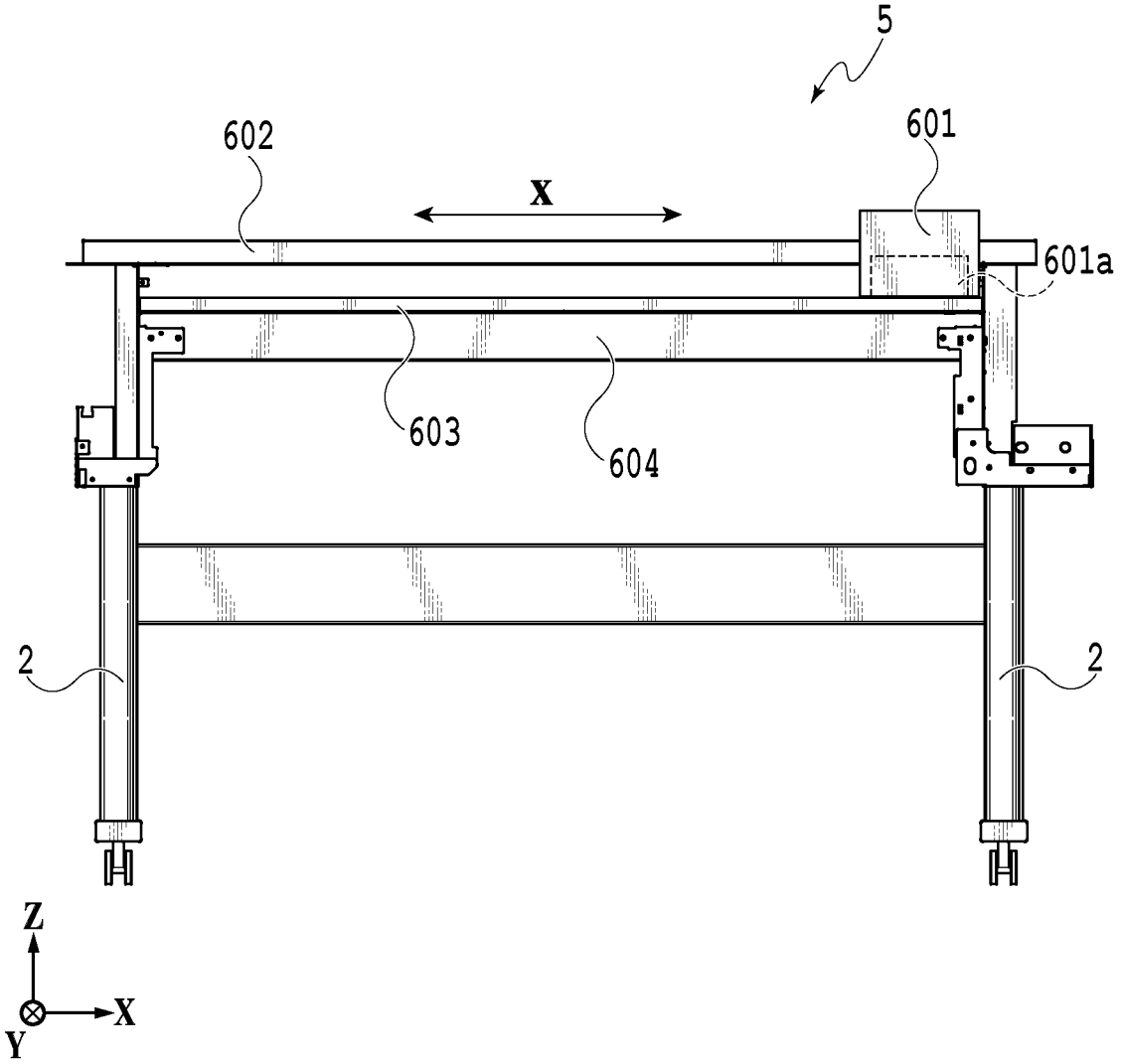
FIG. 2 is a front view illustrating a printing unit provided in the body of the printing apparatus.

Hereinafter, a first embodiment of the present invention will be described in detail with reference to the drawings. FIG. 1A is a perspective view illustrating a printing apparatus 10 (printing apparatus) according to this embodiment, and FIG. 1B is a side view of the printing apparatus 10. FIG. 2 is a front view illustrating a printing unit provided in the body of the printing apparatus 10.

First, referring to FIGS. 1A and 1B and FIG. 2, description will be provided for a configuration outline of the printing apparatus 10 according to an embodiment of the present invention. The printing apparatus 10 has a body 1, legs 2 supporting the body 1, and a stacker 3 (sheet storage apparatus) (described later) which can move to be in contact with or apart from the legs 2. The body 1 has a first roll holding unit 160 and a second roll holding unit 161 which rotatably hold roll sheets 162 formed by winding a long length sheet around a spool. A sheet delivered from a roll sheet held in the first roll holding unit 160 or the second roll holding unit 161 is fed to a printing unit 5 via a feeding mechanism (not illustrated) and the like. The second roll holding unit 161 is located below the first roll holding unit 160. Note that the second roll holding unit 161 may have a function capable of rolling up a sheet fed from the first roll holding unit 160 and subjected to printing. The first roll holding unit 160 and the second roll holding unit 161 are feeding units for feeding a sheet to the printing unit. Each feeding unit includes a roll sheet, a rotation drive mechanism (not illustrated) for the roll sheet, and nip arms (described later).

In addition, the body 1 includes a conveyance unit to convey a sheet W which is a print medium delivered from the roll sheet stored in the first roll holding unit 160 or the second roll holding unit 161 and also includes the printing unit 5 to perform printing on the conveyed sheet W. The printing unit 5 includes a carriage 601 on which a printing head is mounted as illustrated in FIG. 2, and which moves in the sheet width direction (a direction orthogonal to the sheet discharging direction or the main scanning direction (X direction)), a print head 601*a* mounted on the carriage 601, and a carriage stay 602 supporting the carriage 601. The carriage 601 is movable in both direction along the main scanning direction (X direction) which is the longitudinal direction of the carriage stay 602. The print head 601*a* performs printing on a sheet while moving in the main scanning direction together with the carriage 601. Note that the print head 601*a* used in this embodiment is an ink jet print head which discharges ink to print an image on the sheet W. The print head is not limited to this type, but another print head such as a heat transfer print head can be used. The conveyance unit for conveying a sheet includes a non-illustrated conveyance roller, a platen 603 located below the carriage, a platen stay 604 for supporting those, and some other parts.

The body 1 has the discharge port 1*a* for discharging the printed sheet W and a discharge port guide 1*b* for guiding the discharged sheet to the stacker 3. A cutter 6 is provided between the printing unit 5 and the discharge port (discharge unit) 1*a*. A printed sheet is cut by the cutter 6. Note that the discharge port 1*a* is located above the roll holding units 160. The sheet is gradually discharged through the discharge port 1*a* along with the printing operation. After the sheet passes the discharge port guide 1*b*, the sheet changes the moving direction downward by its own weight and hangs down. In view of the exchangeability of roll sheets by the user, the two roll holding sections 160 and 161 are provided at around the center position in the height direction of the printing apparatus 10.

As illustrated in FIG. 1B, the first roll holding unit 160 and the second roll holding unit 161 are provided on the front side of the printing apparatus 10, where the discharge port 1*a* is formed. With this structure, for example, after the stacker 3 is moved away, and the housing of the body 1 is opened from the front side of the printing apparatus, a roll sheet can be set into the first roll holding unit 160 provided inside the body 1. This also makes it possible to set a roll sheet into the second roll holding unit 161 from the front side of the printing apparatus. This allows the user to replace a roll sheet from the front side without moving the printing apparatus, reducing the burden on the user due to the replacement work.

The body 1 also has an operation unit 4, and the user operates various switches provided on the operation unit 4 to input various commands, such as ones for specifying a sheet size or for switching between online and offline. Note that although this embodiment is described based on the two roll sheet configuration including the two roll holding units 160 and 161, the present invention is not limited to this configuration. The present invention can be applied to a printing apparatus having three or more roll holding units.

The stacker 3 is for storing a sheet cut by the cutter 6 after printing and has a receiver 40 in a sheet shape, made of thin, flat, and flexible cloth or plastic. This receiver 40 has one end held by a front rod 20 and the other end held by a rear rod 30. In other words, the front rod 20 and the rear rod 30 function as holding members to hold both ends of the receiver 40. Specifically, the front rod 20 holds one end of the receiver 40 on the front side (the left side in FIG. 1B) and the rear rod 30 holds another end of the receiver 40 on a storage space S located below the discharge port 1*a* and the second roll holding unit 161. Each end of the front rod 20 is connected to a respective one of two side rods 11 using a connecting member 12. The side rods 11 are supported by side-rod support members 61. These side-rod support members 61 are attached to the stacker 3 side (described later). An upper rod 121, being inserted in the sheet width direction into a tube-like portion (not illustrated) provided in the receiver 40, holds the receiver 40 between the front rod 20 and the rear rod 30. The upper rod 121 is positioned on the stacker 3 side (described later) and supports the receiver 40. In other words, the upper rod 121 is movable and functions as a support member for supporting a middle portion of the receiver 40.

The role of the receiver 40 is to recieve the sheet without dropping it on the floor or the like. For this reason, a space directly below the body 1 is used as a storage space to receive large sheets in various modes. Examples of the various discharging modes include the face-up mode and the face-down mode. The face-up mode is a sheet discharging mode in which the printed surfaces of sheets face upward, and following sheets are stacked thereon. The face-down mode is a mode in which sheets are received with the printed surfaces facing downward, and following sheets are stacked thereon. In the face-down mode, the leading edge of a curled succeeding sheet is not caught on the print surface of the preceding sheet while the succeeding sheet is discharged, unlike the face-up mode in which printed sheets are stacked one after another with the printed surfaces facing up. As a result, the face-down mode has an advantage that fewer scratches are formed on the printed surface. In addition, the face-down mode has another advantage that since printed objects (printed objects) are stacked in the order of printing when counted from the printed surfaces, there is no need for the user to rearrange the stacked printed objects in the order of printing.

Figure 3A:
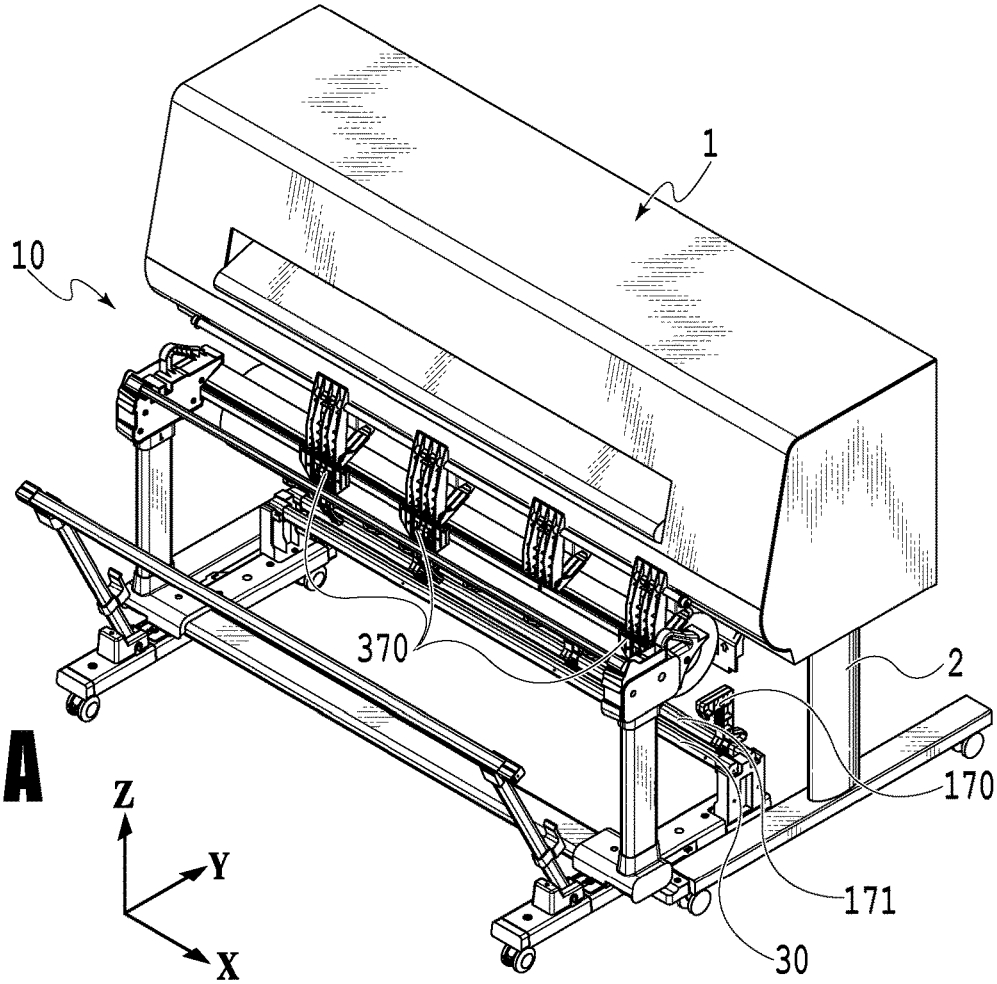
FIG. 3A is a perspective view illustrating the printing apparatus with a receiver removed.
Figure 3B:
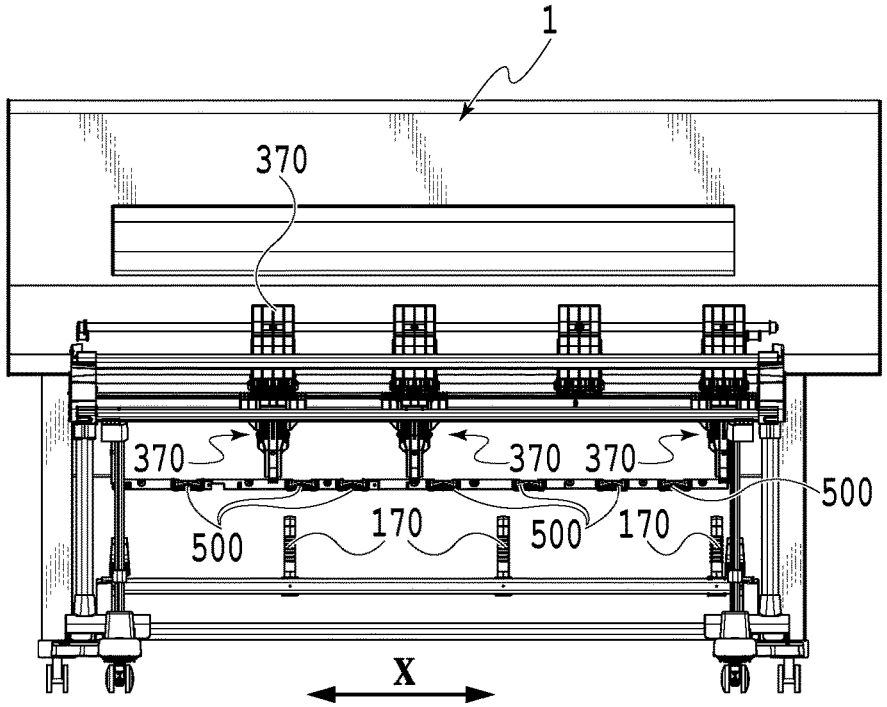
FIG. 3B is a front view illustrating the printing apparatus with a receiver removed.

As illustrated in FIGS. 1B, 3A, and 3B, the stacker 3 has multiple first sheet abutting members 170. The multiple first sheet abutting members 170 are lined on a stopper rod 171, which is provided in parallel with the rear rod 30, in the sheet width direction (a direction intersecting (orthogonal to) the sheet discharging direction). The first sheet abutting members 170 are provided on the stopper rod 171 provided in parallel with the rear rod 30 positioned by rod holding members 31 attached to the stacker 3 side (described later). The rear rod 30 and the stopper rod 171 are detachably attached and positioned on rod holding members 31 via rod caps 172 attached to both ends of these two rods. The first sheet abutting members 170 constitute a first sheet abutting unit which receives and stops a printed sheet guided by the receiver 40. This first sheet abutting members 170 will be described later in detail. Note that these first sheet abutting members 170 are located, for example, on the rear side (back side) of the printing apparatus relative to the second roll holding unit 161. In other words, the stacker 3 has a storage unit formed to be capable of storing a sheet, including a space located below the second roll holding unit 161 in the gravity direction. With this structure, the printing apparatus 10 utilizes the space below the second roll holding unit 161 as part of the storage unit, which makes the printing apparatus 10 smaller in the depth direction (front-rear direction).

Figure 4:
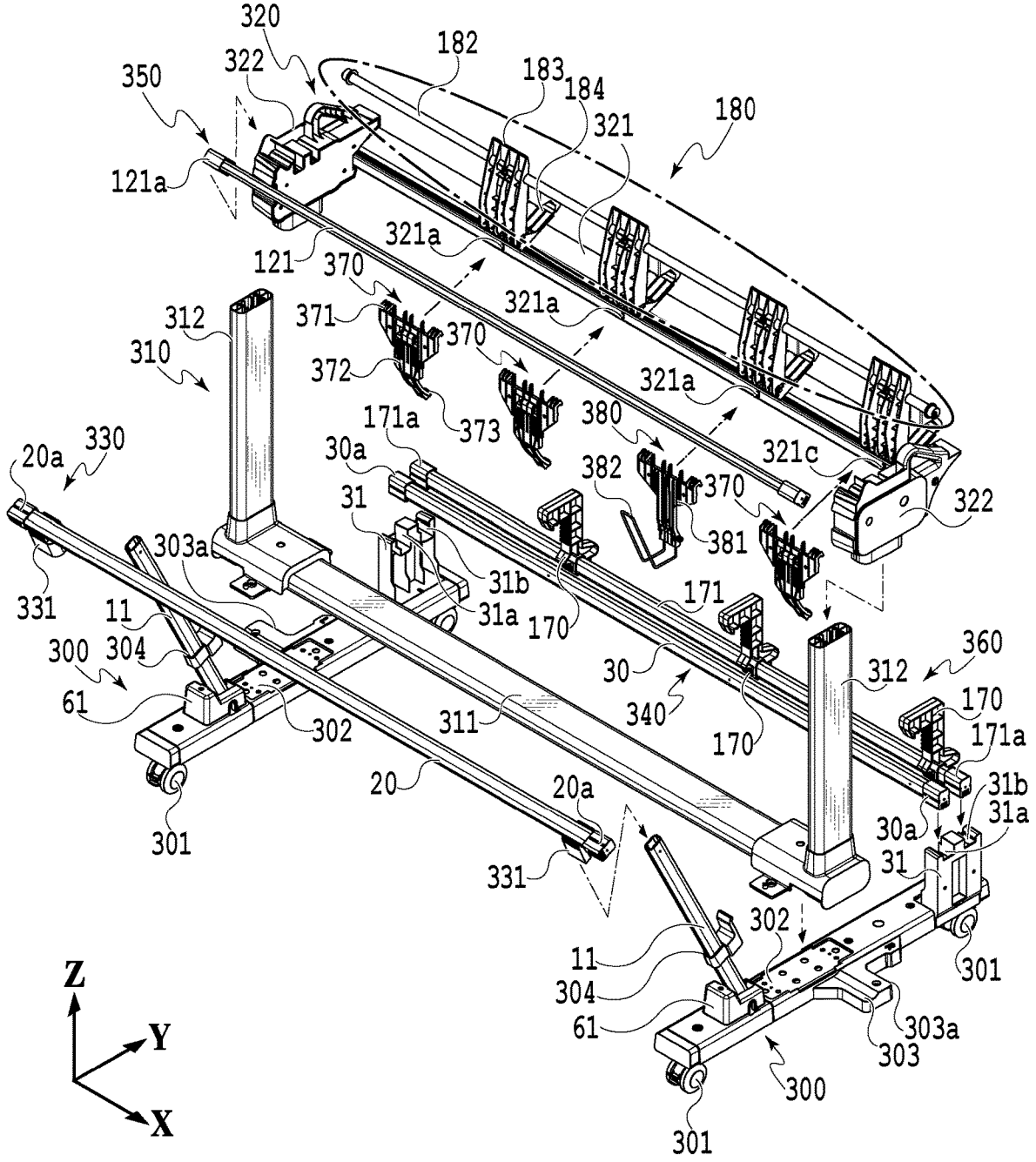
FIG. 4 is an exploded perspective view of a sheet storage apparatus.
Figure 5A:
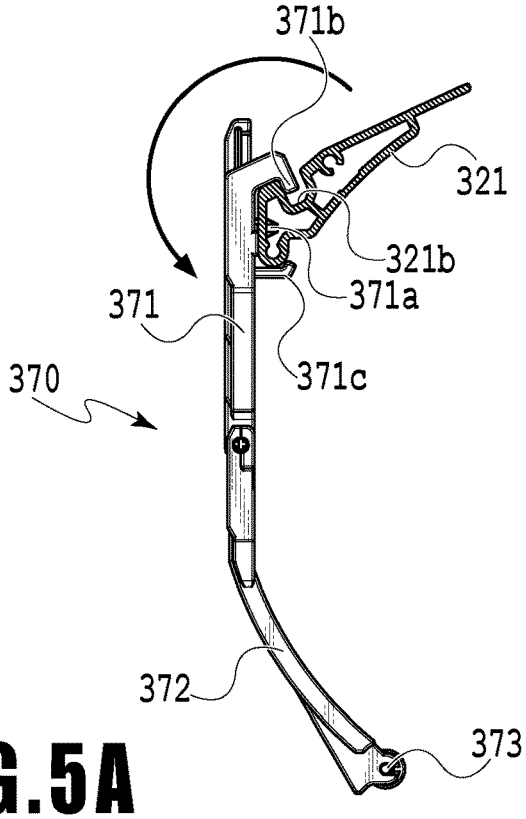
FIGS. 5A to 5C are diagrams illustrating a roll guide unit and a second sheet stopper unit according to a first embodiment.

Next, using FIGS. 3A, 3B, 4, 5A, to 5B, and 6 the configuration of the stacker 3 will be described in more detail. FIG. 3A is a perspective view illustrating the printing apparatus, and FIG. 3B is the front view. FIG. 4 is an exploded perspective view of the sheet storage apparatus illustrated in FIG. 3A, FIGS. 5A to 5C are diagrams illustrating a roll guide unit and a second sheet stopper unit, and FIG. 6 is a perspective view illustrating the body and the sheet storage unit of the printing apparatus 10, which are separated. Note that FIGS. 3A, 3B, and 4 illustrate the states without the receiver 40 to clarify the configuration of each part of the receiver supporting mechanism of the stacker 3 to be described below.

The exploded perspective view illustrated in FIG. 4 indicates a state before the stacker 3 is set up. The one-dot chain lines in the figure indicate the connection relationship of each part for setting up.

Units for setting up (including stetting up with screws) include uni-foot units 300, a stay leg unit 310, a back stay unit 320, a front rod unit 330, a rear rod unit 340, and an upper rod unit 350. Units for setting up further include a first sheet stopper unit 360 having the first sheet abutting members 170, multiple roll guide units (also called flappers) 370 attachable in the sheet width direction, and a second sheet stopper unit 380.

Each of the right and left foot units 300 has two casters 301 attached to a foot frame 302 and is movable in the X and Y directions in the figure, so that the foot units 300 can move to be in contact with or apart from the non-illustrated body 1. Further, attached to each of the foot frames 302 are a side-rod holding member 61 rotatably holding the side rod 11 and a rod support member 31 holding the rear rod unit 340 and the first sheet stopper unit 360. Attached to each of the two side rods 11 is a rod holder 304 for receiving the upper rod unit 350. These holders are members for placing the upper rod unit 350 as necessary in the case where the receiving mode of the receiver 40 of the stacker 3 (described later) is changed.

The stay leg unit 310 has a stay 311 in an elongated shape in the width direction of the roll sheet (X direction) and legs 312 connected to both ends of the stay 311. Each of legs 312 has an elongated shape in the up-down direction (Z direction). These two legs 312 and the stay 311 form a shape like a letter U as a whole.

The back stay unit 320 includes a back stay 321 in an elongated shape in the X direction and a guide flapper unit 180 (a portion surrounded by the one-dot chain line in the figure) (described later) disposed on this back stay 321. Further provided on the back stay unit 320 are two upper rod bases 322 attached to both ends of the back stay 321.

The front rod unit 330 includes the front rod 20, rod caps 20*a* provided at both ends of the front rod 20, and two front-rod supports 331. The rear rod unit 340 includes the rear rod 30 and rod caps 30*a* provided at both ends of the rear rod 30. The upper rod unit 350 includes the upper rod 121 and rod caps 121*a* at both ends of the rod. The three rods (the front rod 20, rear rod 30, and upper rod 121) held by these rod units support the receiver 40 illustrated in FIG. 1A.

The first sheet stopper unit 360 has the stopper rod 171 in an elongated shape in the width direction of the roll sheet (X direction). The first sheet stopper unit 360 further includes multiple first sheet abutting members 170 (three in the figure) arranged on the stopper rod 171 and rod caps 171*a* at both end of the rod.

The roll guide unit 370 has a first roll guide 371 as a first guide unit, a second roll guide (turning portion) 372 as a second guide unit turnably attached to the first roll guide 371, and a roller (rotation member) 373 rotatably attached at the lower end of the second roll guide. Multiple (three in the figure) roll guide units 370 can be arranged in the width direction of the roll sheet (X direction).

The second sheet stopper unit 380 has a second sheet abutting member 381 and a wire tray 382 attached to the lower end of the second sheet abutting member.

Here, the setup procedure for each unit indicated in FIG. 4 will be described. For setting up, first, the stay leg unit 310 is fixed to the foot frame 302 of either one of the right and left foot units 300 by tightening screws. Next, the right and left upper rod bases 322 of the back stay unit 320 are inserted into the ends of the legs 312 of the stay leg unit 310 as illustrated with a dot-and-dashed line in FIG. 4, and then fixed by tightening screws. Then, the front-rod supports 331 of the front rod unit 330 are inserted to ends 11*a* of the right and left side rods 11 and fixed by tightening screws as indicated with a dot-and-dashed line in FIG. 4. In addition, the rod caps 30*a* at both ends of the rear rod unit 340 are fitted to recesses 31*a* of the right and left rod holding members 31. Further, the rod caps 172 at both ends of the upper rod unit 350 are fitted into the recesses of the upper rod bases 322 as indicated with a one dot chain line in FIG. 4. Note that the upper rod unit 350 may be placed on the rod holders 304 depending on the receiving mode of the receiver 40. The first sheet stopper unit 360 is fixed to the right and left rod holding members 31 by fitting the rod caps 171*a* at both ends of the stopper rod 171 into recesses 31*b* of the rod holding members 31.

Meanwhile, the roll guide unit 370 and the second sheet stopper unit 380 are set up as follows. FIG. 5A is a partial cross-sectional view illustrating the setup state of the roll guide unit 370, and FIG. 5B is a partial cross-sectional view illustrating the setup state of the second sheet stopper unit 380.

In FIG. 5A, the roll guide unit 370 is set up to the back stay unit 320 fixed to the stay leg unit 310 as described earlier, as below. First, a hook-like upper engaging portion 371*b* of the first roll guide 371 is hooked on an indent 321*b* of the back stay 321. Then, the first roll guide 371 is turned in the arrow direction while a shaft 371*a* projectingly provided in the first roll guide 371 is being inserted into a hole 321*a* (FIG. 4) of the back stay 321 for positioning. By doing this, a hook-like lower engaging portion 371*c* projectingly provided in the first roll guide 371 is elastically deformed and goes over the lower end of the back stay 321 to be engaged. The roll guide unit 370 is eventually held in the state where the roll guide unit 370 is holding the back stay 321 with the upper engaging portion 371*b* and the lower engaging portion 371*c*. The setup is completed in this state. Incidentally, by turning the first roll guide 371 in the direction opposite to the arrow in the figure, the roll guide 371 can be detached from the back stay 321.

In this way, setting up the roll guide unit 370 is easy because the roll guide unit 370 can be attached to or detached from the back stay 321 without using fasteners, such as screws. In addition, in the case where an unexpected excessive external force is exerted on the roll guide unit 370, the roll guide unit 370 and the back stay 321 are detached, which prevents these members from being damaged beforehand.

The second sheet stopper unit 380 includes the second sheet abutting member 381 and the wire tray 382 provided at the lower end thereof. The second sheet stopper unit 380 is set up by inserting a shaft 381*a* into a hole 321*c* of the back stay 321 with an engaging portion 381*b* of the second sheet abutting member 381 hooked on an indent 321*b* of the back stay 321. This makes it possible to set up the second sheet abutting member 381 at a specified position. With this configuration, the second sheet abutting member 381 can be easily attached to or detached from the back stay 321. Thus, in the case where the receiving mode of the receiver 40 needs to be changed as described later, the user can attach or detach the second sheet stopper unit 380 as appropriate depending on the receiving mode. In order to avoid erroneous mounting of the roll guide unit 370 and the second stopper unit 380, the shaft 371*a* and the shaft 381*a* are formed at different positions in the X direction.

Figure 5C:
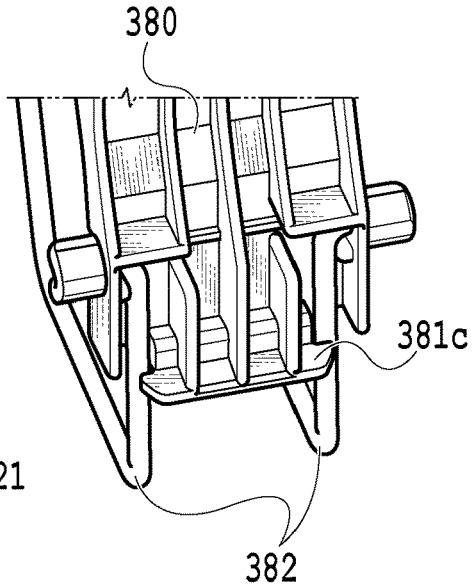
Figure 5B:
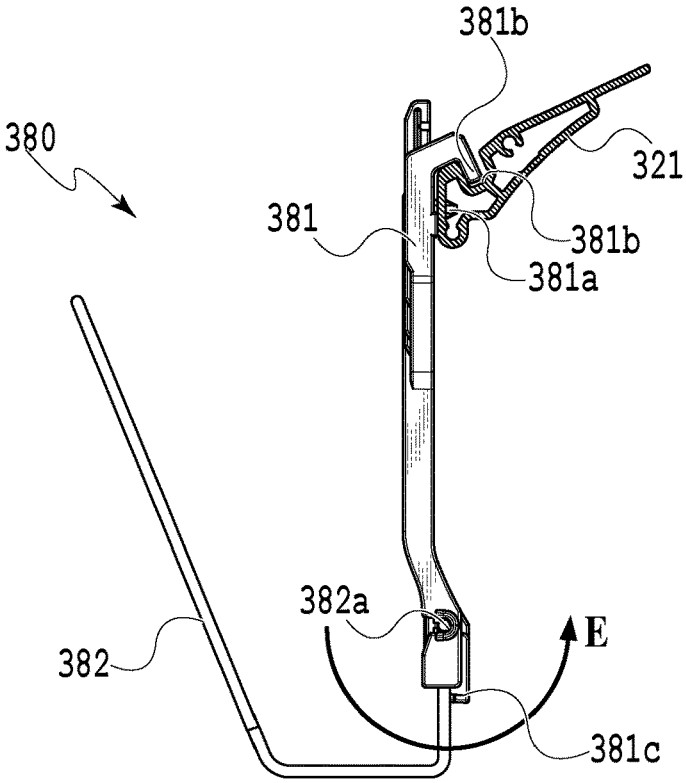
Figure 6:
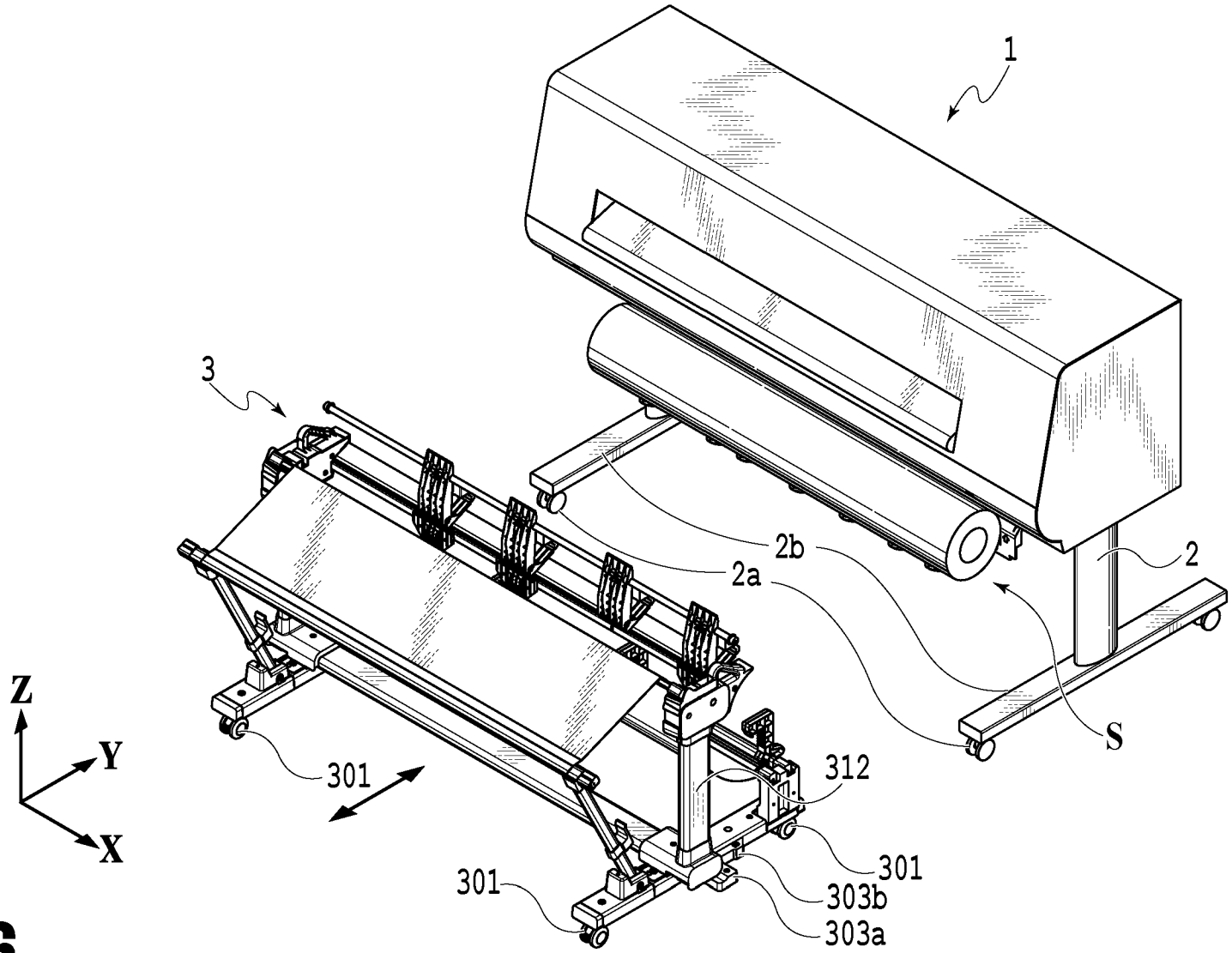
FIG. 6 is a perspective view illustrating the body of the printing apparatus and the sheet storage apparatus which are separated.

The wire tray 382 attached at the lower end of the second sheet abutting member 381 in FIG. 5B is turnable around one end 382*a* in the direction of arrow E, and normally, the turning range is restricted by turn stoppers 381*c* (see FIG. 5C). However, when excessive force is exerted on the wire tray 382, the wire tray 382 comes off the turn stoppers 381*c* and turns to release the load before the second stopper unit 380 or the back stay 321 is broken. Note that this second stopper unit 380 is not used when the roll guide units 370 (described earlier) are used. In other words, in the mode (first receiving mode) in which the guide units 370 are set up to receive sheets, the second stopper unit 380 is not set up. The second stopper unit 380 is set up in a second receiving mode which is different from the first receiving mode.

The stacker 3 in this embodiment is independently configured from the body 1. In a printing operation, the stacker 3 is moved to the position, where the stacker 3 is in contact with the body 1, for use. It is also possible to move the stacker 3 apart from the body 1 as necessary. FIG. 6 is a diagram illustrating a state where the stacker 3 is apart from the body 1. The user moves the stacker 3 using the casters 301 in the Y direction (horizontal direction) from the state in FIG. 6 and brings contact surfaces 303*a* (see FIG. 4) formed on right and left contact members 303 into contact with surfaces 2*a* on the front side of the legs 2 of the body 1. In this state, the printing apparatus is ready for use. In the state where the stacker 3 is set up to the body 1, a storage space S for printed objects W is formed between the receiver 40 and the body. Use of the storage space S makes it possible to stack printed objects W on the stacker 3 in the face-down mode (described earlier).

The guide flapper unit 180 includes multiple (four in the figure) guides 184 fixed to the back stay 321 and flappers 183 attached to the respective guides 184 to be turnable (capable of opening and closing) around turning centers 189. The guide flapper unit 180 further includes sheet guide holders 186 fixed to the respective guides 184 and sheet guides 185 provided in the respective sheet guide holders 186.

Figure 7A:
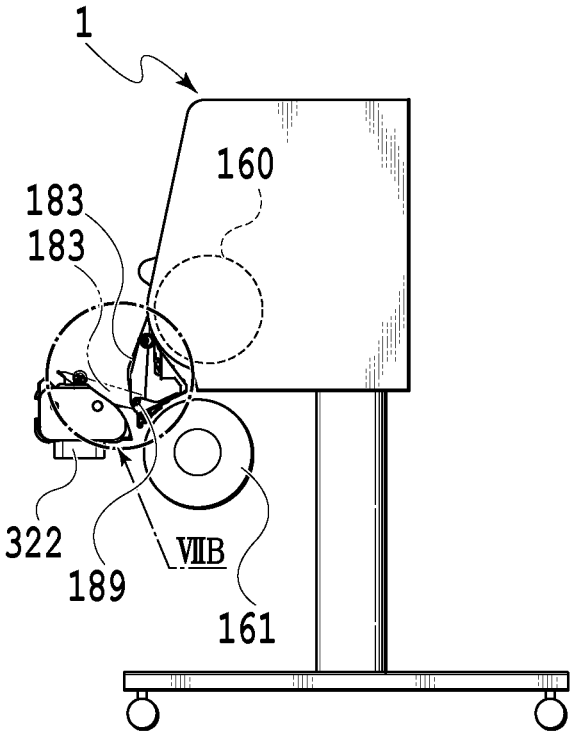
FIG. 7A is a side view illustrating part of the printing apparatus.

Here, the opening and closing states of the flapper 183 will be described referring to FIGS. 7A and 7B. First, the opening state of the flapper 183 means the state where a lateral recess 186*a* (see FIG. 7B) formed by the guide 184 and the sheet guide holders 186 is open. In this state, the flapper 183 is located at a position where the flapper 183 can support the leading edge portion (an area with a specified length from the leading edge) of the sheet being discharged from the discharge port 1*a*. Next, the closing state of the flapper 183 means the state where the recess 186*a* is covered with the flapper 183. In this state, the flapper 183 is located at a position where the flapper 183 cannot support the leading edge portion of the sheet (printed object) being discharged from the discharge port 1*a*.

Figure 7B:
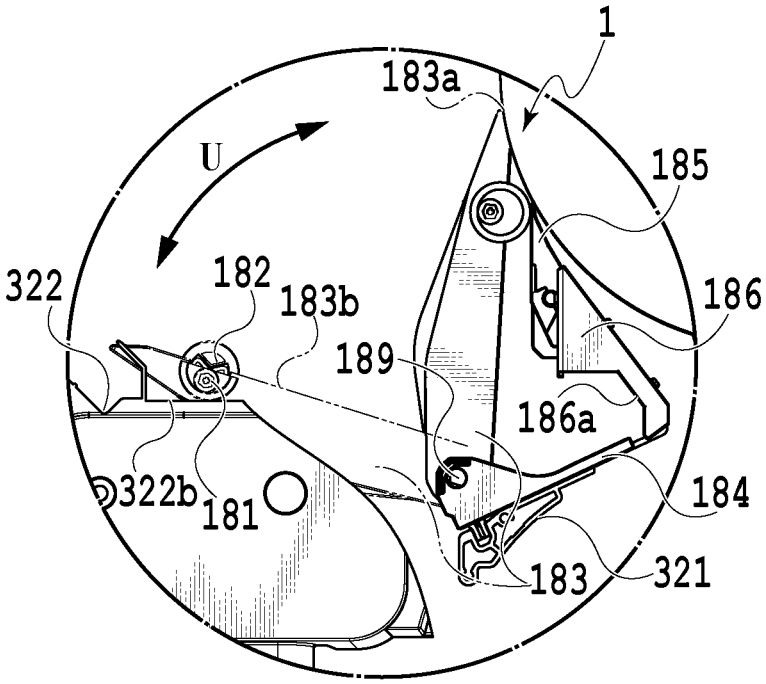
FIG. 7B is an enlarged view of circle VIIB in FIG. 7A.

The guides 184 to which the multiple flappers 183 are attached are lined in the sheet width direction, and each of the multiple flappers 183 can open and close in the direction of arrow U (FIG. 7B). The flappers 183 and the guides 184 serve as guide units or supporting portions of the printed object.

In the state where the flapper 183 is turned counterclockwise (opened) in the direction of arrow U in FIG. 7B, the distal end of the sheet guide 185 is in contact with the body 1. The sheet guide 185 is spring-biased toward the body 1 using a non-illustrated torsion coil spring, and this biasing force brings each sheet guide 185 into contact with the body 1. The sheet guide 185 in the opening state serves as a guide for passing the leading edge of the printed object discharged from the discharge port 1*a* from the body 1 side to the guide 184 side. Meanwhile, in the state where the flapper 183 is turned clockwise (closed) in the direction of arrow U in FIG. 7B, a distal end 183*a* of the flapper 183 is in contact with the body 1 (the first receiving mode and second receiving mode (described later)). In this closing state, the flapper 183 serves as a guide for leading the leading edge of the sheet downward. Note that the turning center 189 of the flapper 183 is provided such that the turning center 189 provided at an end portion of the flapper 183 is always located below the center of gravity of the flapper 183 in the gravity direction. Thus, by the turning center 189, the distal end 183*a* of the flapper 183 gets close to (in contact with) the body 1 by its own weight in the closing state, and the distal end 183*a* gets apart from the body 1 in the opening state.

As described above, in this embodiment, the sheet receiving mode of the receiver 40 can be changed as appropriate by changing the opening and closing state of the flappers 183 and the attaching position of the upper rod unit 350, for example. In other words, for receiving the sheet (printed object) discharged from the discharge port 1*a* with the stacker 3, the user can select various receiving modes. This feature sufficiently satisfies the needs for recent diversification of print modes.

Figure 8A:
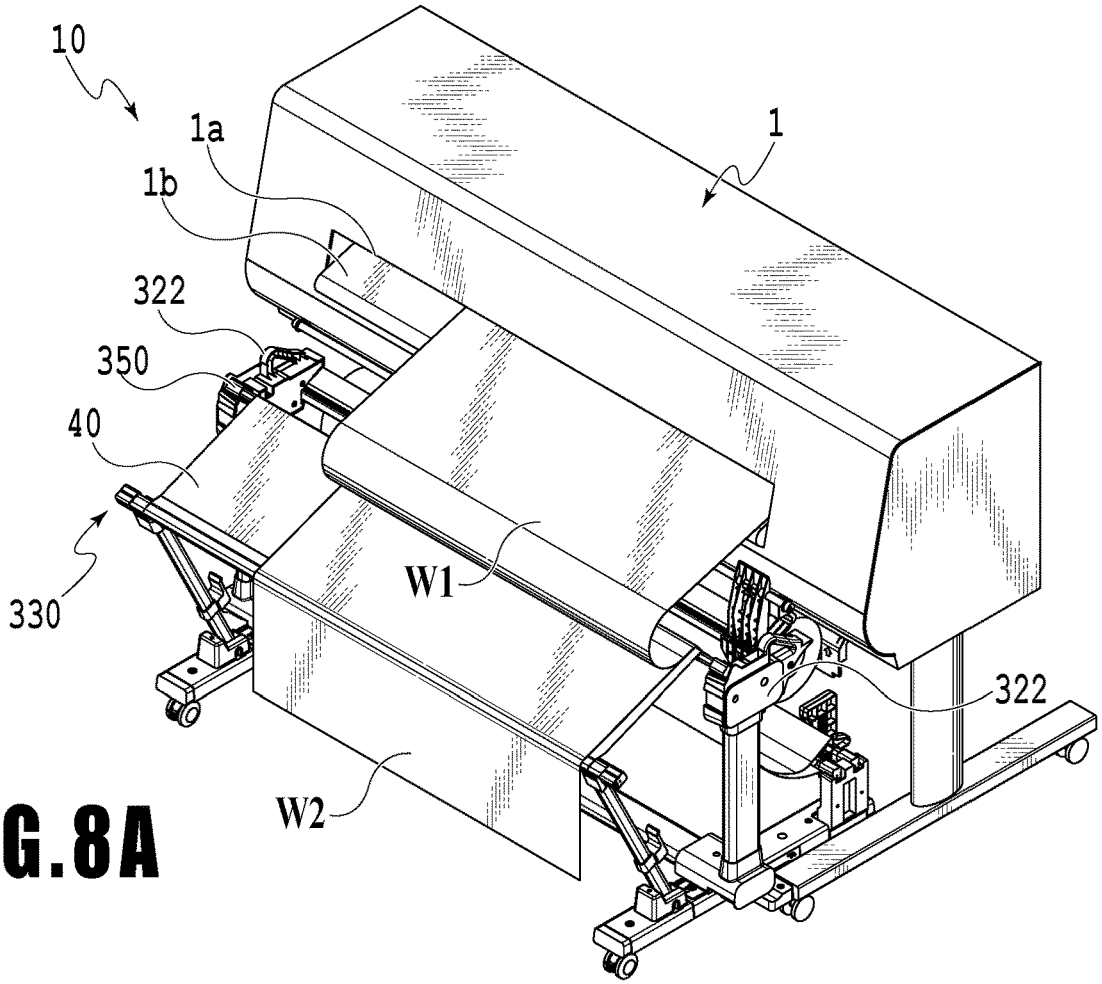
FIG. 8A is a perspective view illustrating the printing apparatus with sheets discharged.
Figure 8B:
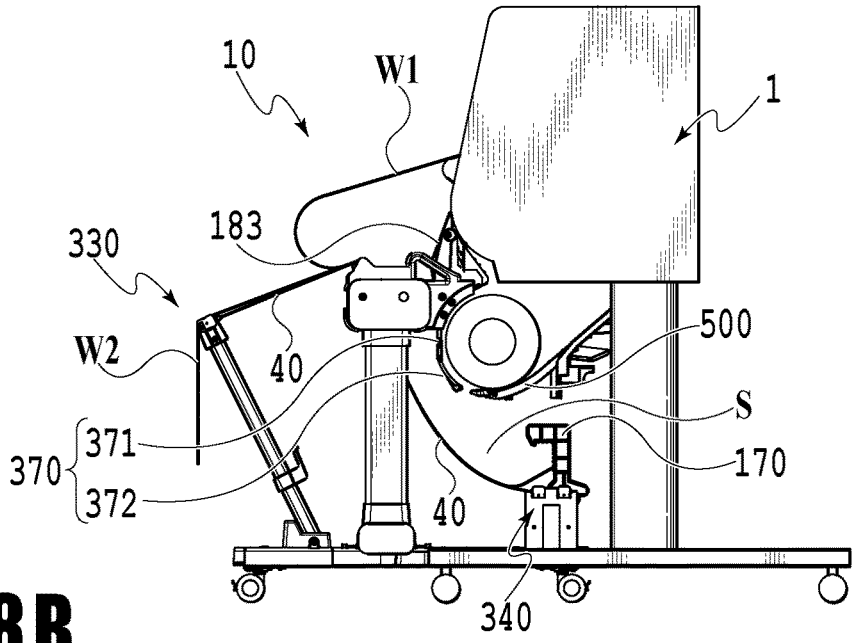
FIG. 8B is a side view illustrating the printing apparatus with sheets discharged.
Figure 9A:
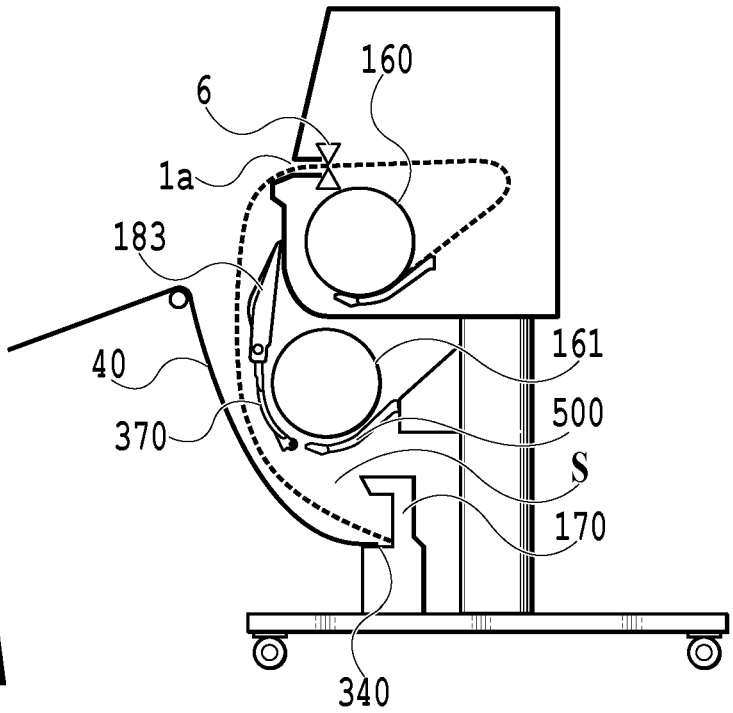
FIGS. 9A and 9B are schematic diagrams illustrating the movement of a sheet and a printed object in the printing apparatus.
Figure 9B:
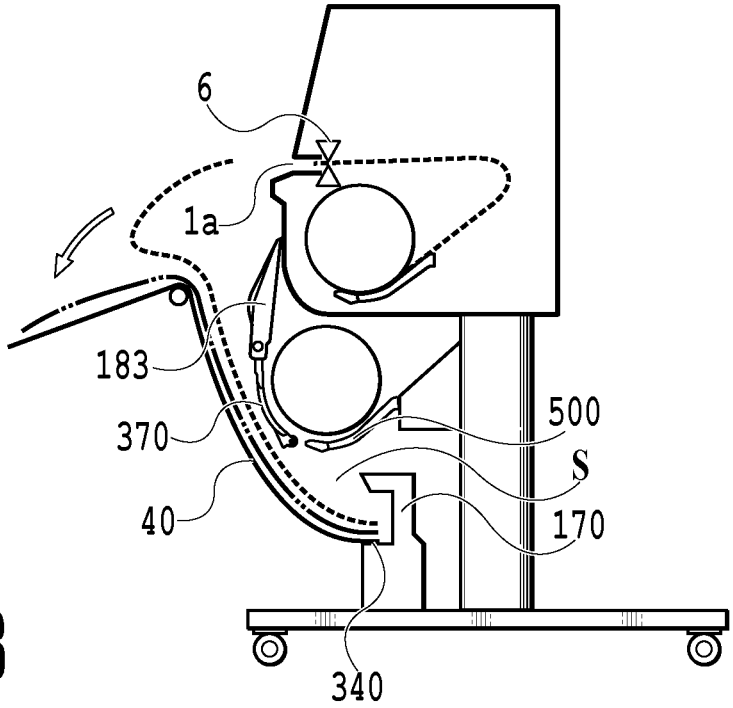
Figure 10A:
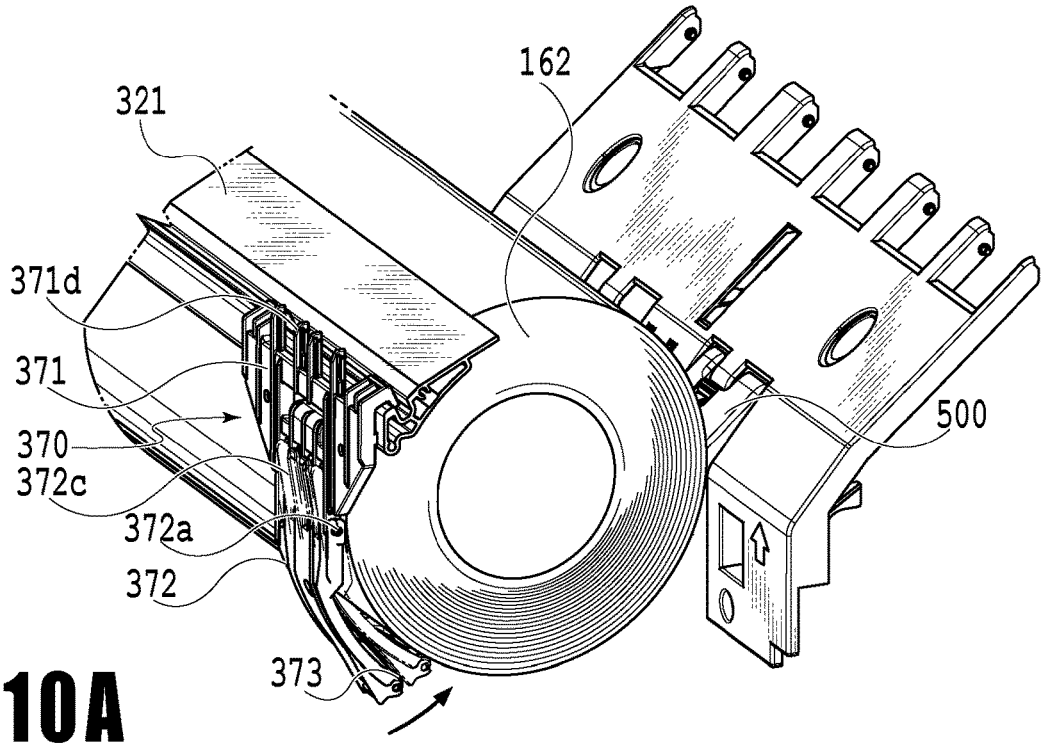
FIGS. 10A and 10B are partial perspective views of FIGS. 8A and 8B.
Figure 10B:
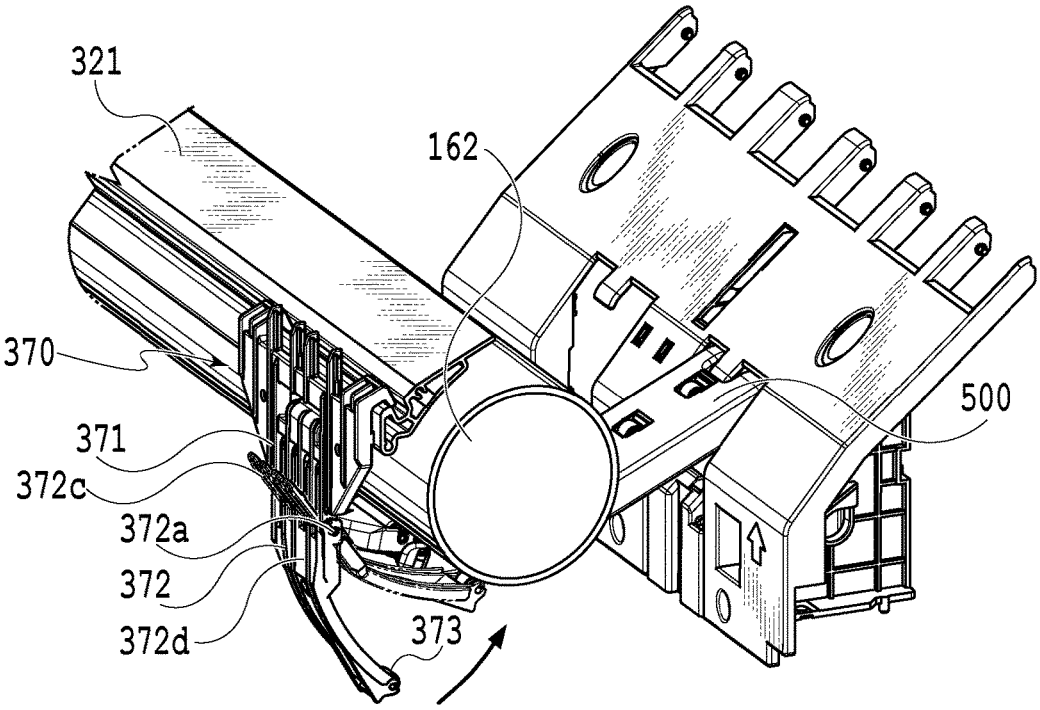
Figure 11A:
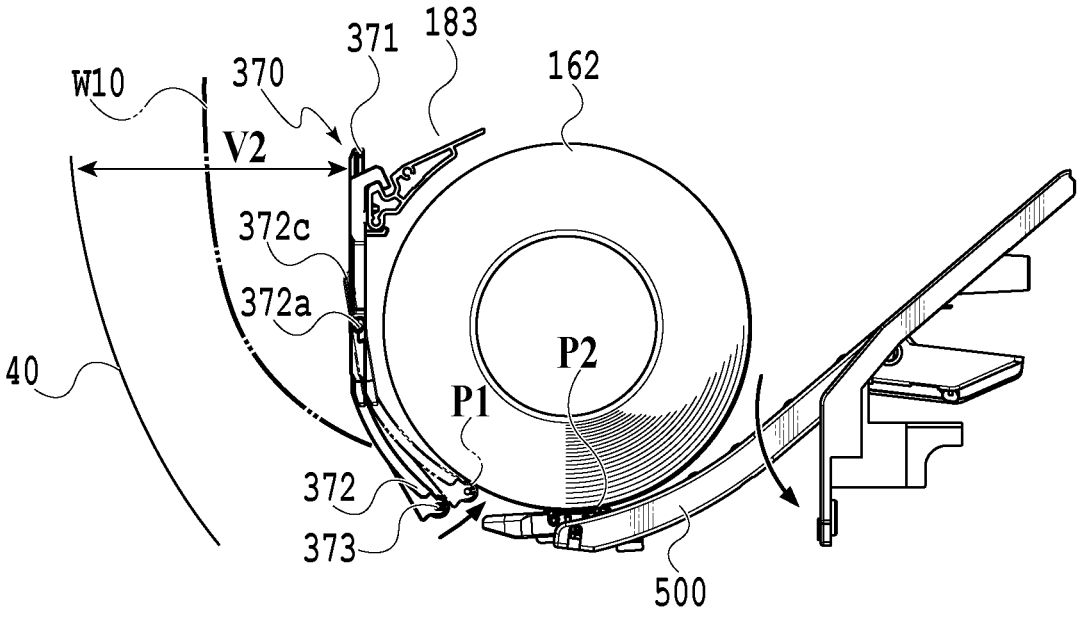
FIGS. 11A and 11B are partial side views of FIGS. 10A and 10B.
Figure 11B:
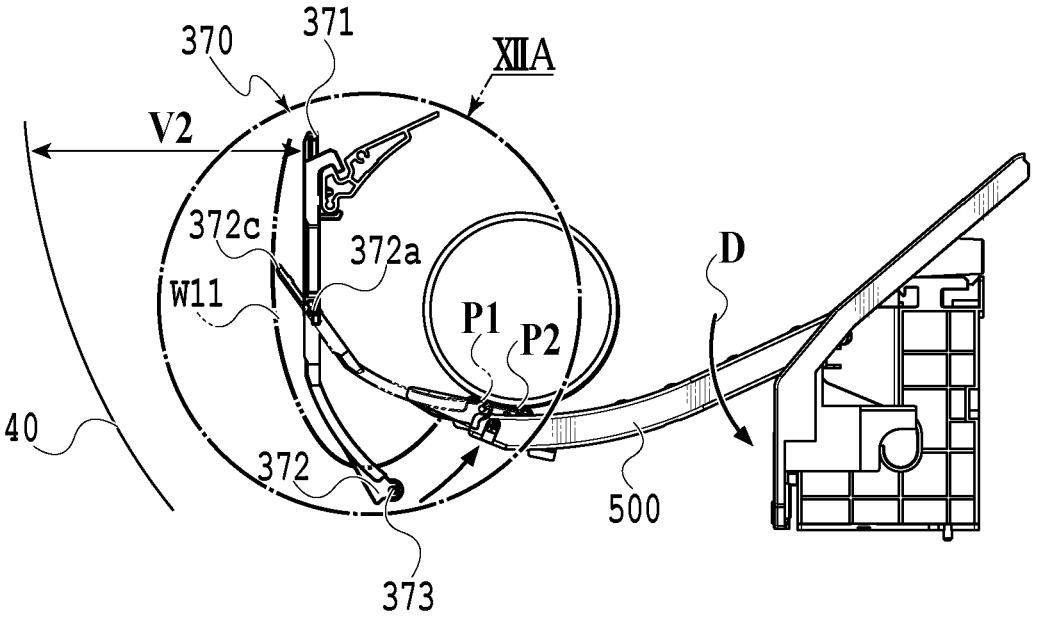
Figure 12A:
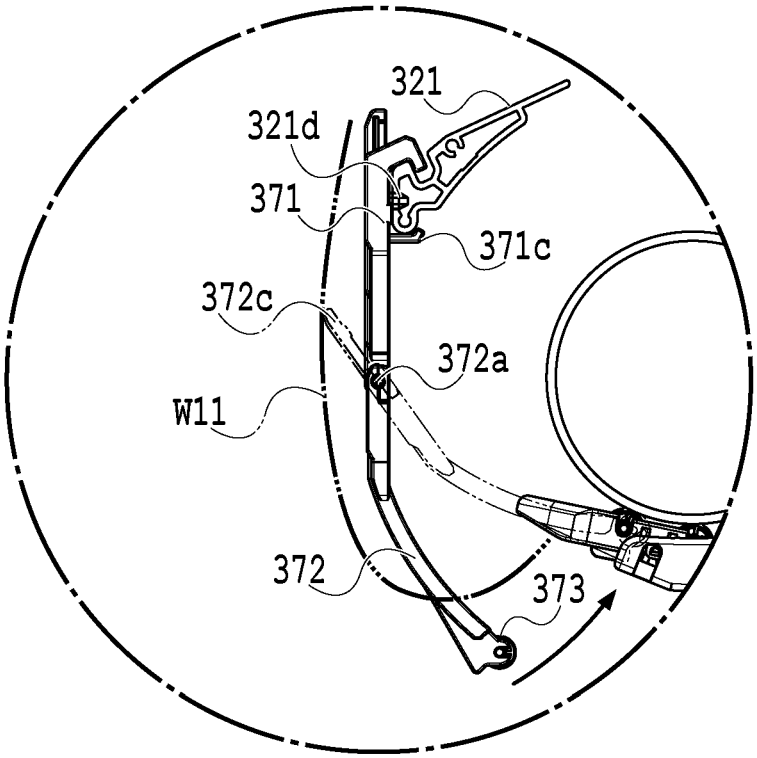
FIG. 12A is an enlarged view of circle XIIA in FIG. 11B.
Figure 12B:
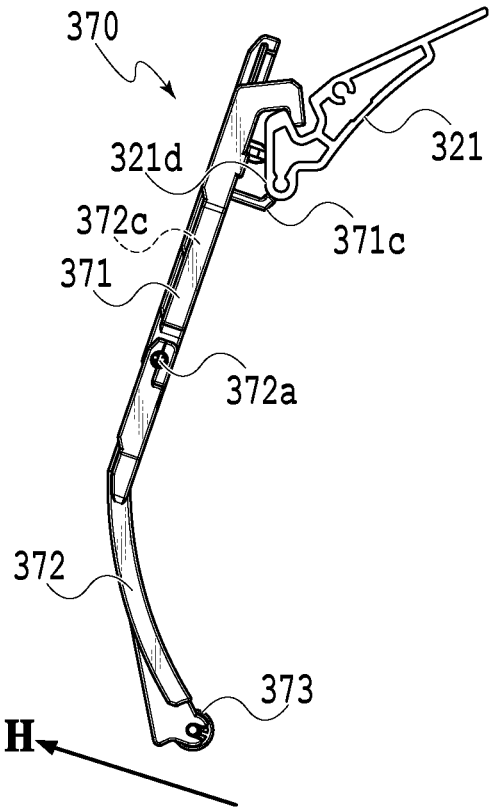
FIG. 12B is a diagram for explaining the operation of the roll guide unit.

FIGS. 8A and 8B are diagrams of the printing apparatus 10 illustrating the state where a printed object is stacked on the stacker 3 in the first receiving mode and the state where a printed object is being discharged from the discharge port 1*a*. FIG. 8A is a perspective view, and FIG. 8B is a side view. FIGS. 9A and 9B are diagrams schematically illustrating states where a sheet and a printed object are moving. FIG. 9A illustrates a state before a printed object is cut off the roll sheet, and FIG. 9B illustrates a state where the printed object has been cut off the roll sheet. In addition, FIGS. 10A and 10B are partial perspective views of FIGS. 8A and 8B; FIGS. 11A and 11B are partial side views of FIGS. 10A and 10B; FIG. 12A is an enlarged view of circle XIIA in FIG. 11B; and FIG. 12B is a diagram for explaining operation of the roll guide unit.

As illustrated in FIGS. 8A and 8B, the upper rod unit 350 is positioned on the right and left upper rod bases 322, and the rear rod unit 340 is positioned on the rod holding members 31. With this configuration, the flexible receiver 40 is held by the upper rod unit 350, front rod unit 330, and rear rod unit 340 to be in an inverted V shape. Between this receiver 40 and the second roll holding unit 161 are formed the storage space S for storing printed objects and a guide path for guiding a sheet from the discharge port 1*a* toward the storage space S.

Hereinafter, a unit forming the storage space S is called a storage unit. Note that in this embodiment, the length of the receiver 40 is determined such that a gap V2 as a guide path, through which a printed object (W10, W11) discharged from the discharge port 1*a* and drooped can pass, is formed between the first roll guide 371 and the receiver 40 as illustrated in FIGS. 11A and 11B. In other words, the curvature (slackness) of the receiver 40 is adjusted by the length of the receiver 40 from the upper rod 121 to the rear rod 30, and the degree of this curvature determines the gap V2 formed between the receiver 40 and the first roll guide 371.

As illustrated in FIGS. 3A, 3B, and 4, the multiple roll guide units 370 are arranged in the X direction. Each roll guide unit 370 is arranged at a position where it does not interfere with the nip arms 500 provided in the feeding unit for feeding the roll sheet (FIGS. 11A and 11B). Each of the nip arms 500 has a nip portion configured to come into contact with the outer circumferential surface of the roll sheet held in the second roll holding unit 161, and multiple (seven in this embodiment) nip arms 500 are arranged in the width direction of the roll sheet (X direction). In this embodiment, three roll guide units 370 are arranged at positions where they do not interfere with these seven nip arms 500, in other words, at different positions in the X direction (see FIG. 3B).

In addition, as illustrated in FIGS. 10A, 10B, 11A, and 11B, the second roll guide 372 which is part of the roll guide unit 370 is connected below the first roll guide 371 to be turnable around a rotation shaft 372*a* located substantially at the same height as the center of the roll sheet 162. At the lower end of this second roll guide 372 is provided the roller 373 (roller member) which is rotatable to prevent scratches even in the case where the turned second roll guide 372 touches the roll sheet 162.

Here, description will be provided for the reason why the second roll guide 372 is turnably attached to the first roll guide 372. In the case where the second roll guide 372 is not turnable but is formed integrally with the first roll guide 371, if the lower end of the second roll guide 372 is located below and forward of nip portion P2 of the nip arm 500, the end of the printed object discharged from the discharge port 1*a* will not enter the feeding unit. However, if the roll sheet held in the roll holding unit is strongly curled, and if the printed object discharged from the discharge port 1*a* which is curled comes into contact with a non-turnable roll guide, the printed object is sometimes curled up and closes the guide path (gap V2).

In contrast, in the case where the second roll guide 372 is turnable as in this embodiment, the printed object can be guided to the first sheet abutting members 170 (FIG. 11B) at lower parts of the printing apparatus, whether the printed object is curled or not. This makes it possible to stack many sheets stably in the storage unit. Specifically, when a curled sheet comes into contact with the second roll guide 372, the second roll guide 372 pressed by the curled sheet turns. As a result, even for a curled sheet, the curly shape goes back to normal as it moves while turning the roll guide 372, and the sheet enters the storage space S below the nip arm 500. Thus, the sheet surely reaches the first sheet abutting members 170.

In addition, since the second roll guide 372 turns, the roll guide unit 370 does not use the storage space S in the storage unit more than necessary. This makes it possible to utilize the storage space S of the storage unit efficiently. Meanwhile, in the case where printing operation is performed using a roll sheet in the lower roll holding unit (second roll holding unit) 161, when nipping of the nip arm 500 on the roll sheet 162 is released (when the nip arm 500 is moved in the direction of arrow D), the nip arm 500 is inclined downward. In this case, the leading edge of the discharged sheet may be temporarily caught on the nip arm 500, but there is no possibility of the sheet entering the feeding path of the feeding unit. Also, as the discharge of the sheet progresses, the sheet having been caught on the nip arm 500 is released. Further, arrangement of multiple roll guide units 370 in the sheet width direction makes it possible to perform appropriate guiding for sheet widths of various standard sizes and also prevent the discharged sheet from entering the nip portion.

In addition, since the second roll guide 372 is turnable, even in the case of discharging a strongly curled sheet, the sheet pushes the roll guide 372 and widens the guide path (widens the gap V2). This prevents the curled sheet from curling up in the guide path and disturbing the movement of the sheet to the storage unit.

In general, the more a roll sheet is used, the smaller the diameter of the roll sheet becomes, and the more strongly the sheet is curled. However, in a printing apparatus having multiple roll holding units at upper and lower portions as this embodiment, when the sheet is fed from the lower roll holding unit (the second roll holding unit 161 in this embodiment), the storage space S between the roll holding unit and the receiver 40 is enlarged compared to the initial state. As a result, when the diameter of the roll sheet becomes small, movable guide units 370 enlarge the storage space S and increase the storage capacity, compared to the fixed guide unit described above. In addition, when the diameter of the roll sheet becomes small, the sheet tends to be strongly curled, which requires a wider guide path. However, as the consumption of the sheet progresses and curling of the sheet becomes strong, the diameter of the roll sheet becomes small, so that the turning range of the turnable second roll guide 372 becomes wider and it is possible to widen the guide path. Thus, it is possible to pass even a sheet, which is curled up, through the guide path.

In FIGS. 11A and 11B, P1 indicates a contact position between the second roll guide 372 and the roll sheet 162 (a first contact position), and P2 indicates a position where the nip portion of the nip arm 500 comes into contact with the roll sheet 162 (a second contact position). Here, in this configuration, when the outer diameter of the roll sheet 162 changes from a maximum diameter to a minimum diameter, the length of the rotation locus (movement locus) in the up-down direction of first contact position P1 is smaller than the length of the rotation locus (movement locus) in the up-down direction of second contact position P2. This configuration allows the second roll guide 372 to always cover the nip portion of the nip arm 500 regardless of the diameter of the roll sheet 162. In other words, even though the diameter of the roll sheet changes, it is possible to keep the effect of preventing a sheet from entering the nip portion of the nip arm 500.

As described above, the second roll guides 372 are arranged at positions different from the positions of the nip arms 500 in the sheet width direction (X direction). Thus, when the second roll guide 372 turns, the second roll guide 372 will not interfere with the nip arm 500. The movable range of the second roll guide 372 is not narrowed by the presence of the nip arm 500. Also, when the second roll guide 372 is turned, it will not hit and break the nip arm 500.

In addition, as illustrated in FIGS. 10A and 10B, multiple libs 371*d* and 372*d* extending in the discharging direction are provided in parallel on the surfaces, facing the sheet, of the first roll guide 371 and the second roll guide 372, respectively. Forming the ribs 371*d* and 372*b* extending in the discharging direction in this way reduces the area of contact with the sheet being discharged. When the sheet is discharged with the leading edge in contact with the first roll guide 371 and the second roll guide 372, the greater the resistance to conveyance is, the more easily the sheet is curled. For this reason, the area of contact with the sheet is designed to be small to keep the resistance to conveyance small, resulting in smooth movement of the sheet at the guide path. When the strongly curled sheet has curled up, the printed surface of the sheet comes into contact with the first roll guide 371 and the second roll guide 372. Thus, arranging the ribs on the guide surfaces also makes it possible to prevent scratches on the printed surface. Note that although this embodiment has shown an example of multiple ribs 371*d* and 372*b* provided in parallel in the width direction, a single rib may be formed.

At the lower end of the second roll guide 372 is provided the rotatable roller 373. With this configuration, even if the second roll guide 372 comes into contact with the roll sheet 162 rotating to feed the sheet, the roller rotates following the rotation of the roll sheet 162, so that no damage will occur on the sheet.

Meanwhile, the second roll guide 372 has an extended portion 372*c* extending toward the upstream side of the rotation shaft 372*a* in the discharging direction. In the initial state in which the second roll guide 372 is not in contact with the sheet, this extended portion 372*c* stays within the first roll guide 371 and will not disturb the movement of the sheet in the discharging direction. When the sheet having passed the rotation shaft 372*a* pushes and turns the second roll guide 372 counterclockwise, the extended portion 372*c* protrudes from the first roll guide 371 to the guide path side and pushes out the back surface (non-printed surface) of the sheet W11. This pressing force caused by the extended portion 372*c* acts in a direction for pushing and widening the curl of the sheet W11 and makes the curl releasing timing earlier. This further reduces the possibility of the curled sheet closing the guide path to the storage unit.

As described earlier, the roll guide unit 370 is configured to be detached from the back stay 321 in the case of receiving an external force larger than or equal to a specified value. This prevents the roll guide unit 370 from being damaged beforehand even in the case the user exerts an excessive external force on it. Anticipated cases where excessive external force is exerted on the roll guide unit 370 include, for example, a case in which when the user takes out stacked sheets, the sheets are caught on the roll guide unit 370, and presses the roll guide unit 370 from the back side toward the front side (in the direction of arrow H in FIG. 12B). At this time, not only in the case where the position at which the excessive external force is exerted on the roll guide unit 370 is the first roll guide 371, but also in the case where the position is the second roll guide 372, the roll guide unit 370 is detached from the back stay 321. Specifically, in the case where external force is exerted on the second roll guide 372 in the direction of arrow H, first, the extended portion 372*c* comes into contact with the first roll guide 371. Then, the engagement with the back stay 321 is kept by the elasticity or the part strength of the lower engaging portion 371*c* until the external force exceeds a specified load. When the load exceeds the specified value, the lower engaging portion 371*c* is detached from the lower end of the back stay 321. To prevent the damage of the first roll guide 371 and the second roll guide 372, which are resin molded parts, the specified load at which the lower engaging portion 371*c* is detached needs to be set within each elastic deformation range. In this embodiment, this specified load is set to about 100 gf at around the lower end of the second roll guide 372. Note that this load is set based on the elasticity of the lower engaging portion 371*c*, the friction force generated between the surface of the back stay 321 and the lower engaging portion 371*c*, and other factors.

When external force is exerted from the front side of the printing apparatus, if the load point is on the first roll guide 371 side, a front face 321*d* of the back stay 321, which is a high strength aluminum extruded material, receives the load. If the load point is on the second roll guide 372 side, the second roll guide 372 turns around the rotation shaft 372*a*, preventing the damage.

Next, the behavior of the sheet (printed object) discharged from the discharge port 1*a* will be described with reference to FIGS. 11A and 11B. The sheet (printed object) W10 after printing, discharged from the discharge port 1*a*, passes the guide path and is guided toward the first sheet abutting members 170 provided inside (on the back side of) the storage unit.

Here, if a sheet W1 is curled, the leading edge of the curled sheet W1, directed toward the body 1, moves being guided by the discharge port guide 1*b*, flapper 183, first roll guide 371, and second roll guide 372 and other parts. Then, when the leading edge of the sheet W1 reaches the first sheet abutting members 170, the leading edge of the sheet W1 stops. When the discharge of the sheet W1 continues in this state, the sheet (printed object) W1 forms a loop L in a direction away from the body 1 (FIGS. 8A and 8B) with the position where the upper rod unit 350 is provided as a flection point. After that, the sheet is conveyed by a specified length and cut, then inverted with the position where the upper rod unit 350 is provided as a flection point as illustrated in FIG. 9B, and the sheet is placed on the receiver 40 with the printed surface facing downward. W2 in FIGS. 8A and 8B indicates a sheet placed on the receiver 40.

Although description has been provided as above for the first receiving mode in which part of the sheet is guided to the storage room, and the sheet is placed on the receiver 40 in the face-down mode, the sheet can be placed in another receiving mode in the printing apparatus in this embodiment. For example, the printing apparatus can employ the second receiving mode by setting up the second sheet stopper unit 380 on the back stay 321 for placing sheets. In this case, the wire tray 382 of the second sheet stopper unit 380 provides the same function as that of the first sheet abutting members 170. Specifically, the wire tray 382 comes into contact with the end of the discharged sheet and restricts the movement of the sheet end. The sheet having come into contact with the wire tray 382 is inverted by the subsequent discharge operation and supported on the receiver 40. This second receiving mode is used for the case where sheets smaller than the sheets used in the first receiving mode described earlier are placed in the face-down mode.

Although the flappers 183 are closed in the first receiving mode and the second receiving mode, it is possible to open the flappers 183 and place sheets on the receiver 40. In this case, the leading edge of a sheet discharged from the discharge port 1*a* is guided by the discharge port guide 1*b*, sheet guide 185, and guide 184 and reaches recesses 186*a* of the sheet guide holders 186. After that, as the discharge of the sheet progresses, the sheet is inverted and placed on the receiver 40 in the face-down mode. This third receiving mode is suitable for the case of using sheets even smaller than the sheets used in the second receiving mode.

Further in this embodiment, a fourth receiving mode may be selected which is different from the first to third receiving modes. In this fourth receiving mode, the upper rod 121 is held by the rod holders 304 (see FIG. 1A) provided in middle portions of the side rods 11, the receiver 40 is largely slacked downward, and the flappers 183 are opened. With this configuration, a discharged sheet is gently folded and received on the receiver. This fourth receiving mode is useful for the case where relatively long length sheets are stacked.

In this embodiment, since the second roll guide 372 is turnably supported, even if a sheet used is curled, it is possible to guide the sheet to the storage unit properly and surely without expanding the guide path to the storage unit. In addition, since the second roll guide unit 372 is turnable, it is possible to utilize the storage space in the storage unit usefully. Accordingly, it is possible to expand the actual capacity of the storage unit compared to the case of using fixed guide units which are not turnable. In the case of obtaining the same capacity as in the case of using fixed guide units, it is possible to use a smaller storage unit, which in turn makes it possible to downsize the apparatus and also possible to reduce the installation area.

Second Embodiment

Figure 13:
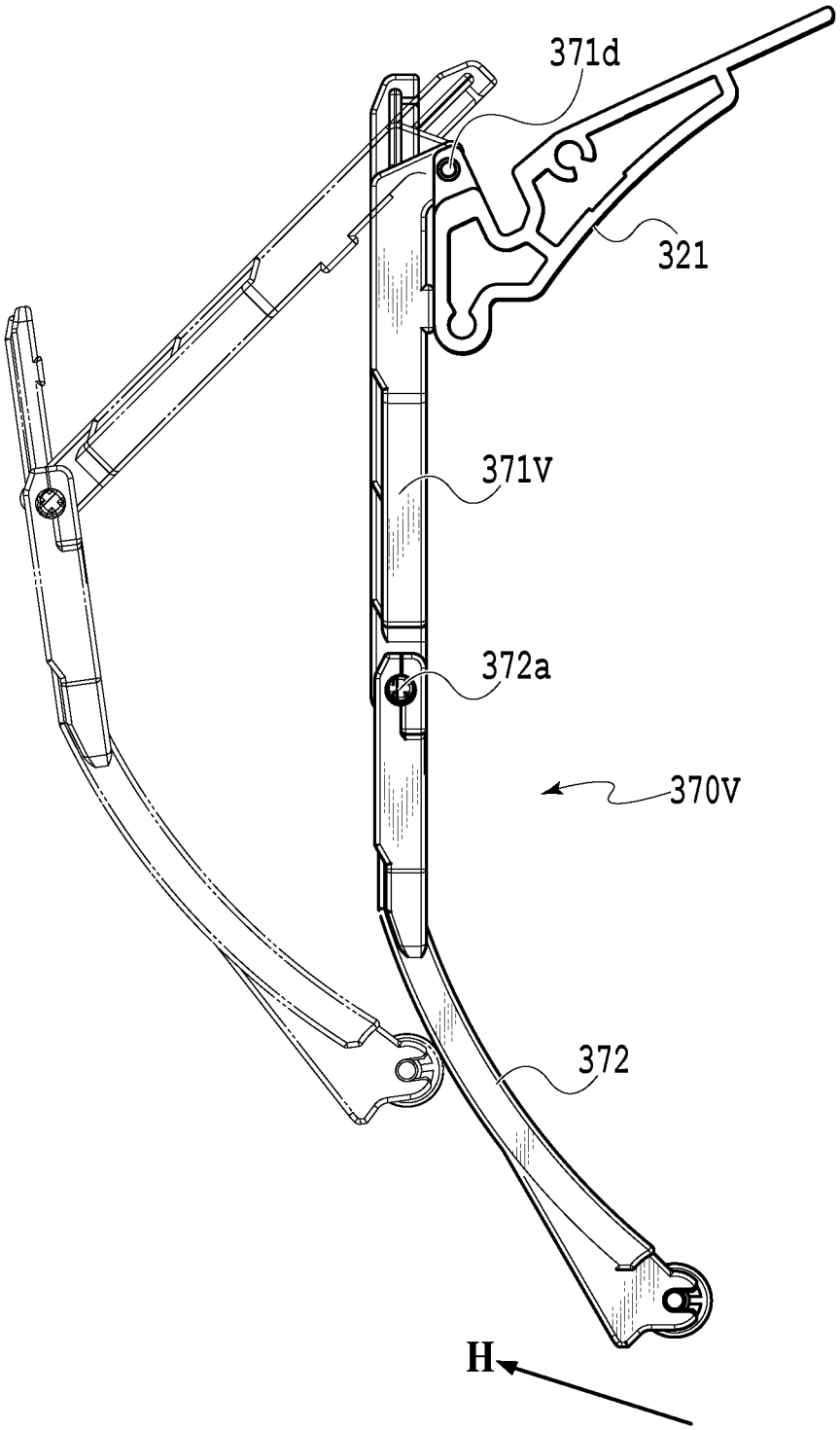
FIG. 13 is a side view illustrating a roll guide unit according to a second embodiment.

Next, a second embodiment of the present invention will be described. A printing apparatus in this embodiment includes roll guide unit 370V illustrated in FIG. 13 instead of the roll guide unit 370 in the first embodiment, and other constituents are the same as in the first embodiment. The roll guide unit 370V has a first roll guide 371V and a second roll guide 372. The second roll guide 372 in this embodiment also has the same configuration as in the first embodiment, but the first roll guide 371V is different from that of the first embodiment. The first roll guide 371V in this embodiment is turnably connected to the back stay 321 with a rotation shaft 371*d* and is not detachable from the back stay 321. However, the roll guide unit 370V in this embodiment also provides the same effect as the roll guide unit 370 (in the first embodiment) which is detachable from the back stay 321. Specifically, when external force is exerted on the roll guide unit 370V in the direction of arrow H, the first roll guide 371V turns around the rotation shaft 371*d* as indicated by the two-dot chain lines in the figure. As a result, excessive stress is not generated in the back stay 321 and the roll guide unit 370V, preventing the roll guide unit 370V and the back stay 321 from being damaged.

Other Embodiments

Although the above embodiments illustrate examples in which the stacker (sheet storage apparatus) including the flexible, flat receiver is provided to be separable from the body, the present invention is not limited to this configuration. In other words, the present invention is applicable to a printing apparatus including a sheet storage unit including a rigid member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-095396 filed May 12, 2017, which is hereby incorporated by reference herein in its entirety.

What is claimed is:

1. A printing apparatus comprising:

a feeding unit comprising a nip arm and configured to support a roll sheet at a nip position of the nip arm and feed a sheet from the roll sheet;

a printing unit configured to perform printing on the sheet fed from the feeding unit;

a discharge unit arranged above the feeding unit and configured to discharge the sheet on which printing has been performed by the printing unit;

a storage unit partially arranged below the feeding unit and configured to store the sheet discharged from the discharge unit; and a guide unit comprising a turning unit configured to turn toward the feeding unit by contacting the sheet discharged from the discharge unit, the guide unit being configured to guide the sheet discharged from the discharge unit toward the storage unit, wherein the position of a lower end of the guide unit in the gravity direction is at the same height as or lower than the nip position of the nip arm.

2. The printing apparatus according to claim 1, wherein a plurality of guide units are arranged along a width direction of the sheet.

3. The printing apparatus according to claim 1, wherein the storage unit has a receiver to receive the sheet discharged from the discharge unit and includes a storage space to store the sheet between the receiver and the feeding unit.

4. The printing apparatus according to claim 1, wherein the position of the lower end of the guide unit in the horizontal direction is even with the position of the nip arm or forward of the position of the nip arm in the printing apparatus.

5. The printing apparatus according to claim 4, wherein when a contact position is defined as a position where the guide unit comes into contact with a surface of the roll sheet, a locus length by which the contact position moves along with a change in the diameter of the roll sheet from a maximum diameter to a minimum diameter is shorter than a locus length by which the nip position moves along with a change in the diameter of the roll sheet from the maximum diameter to the minimum diameter.

6. The printing apparatus according to claim 4, wherein the guide unit is arranged at a position different from the position of the nip arm in a width direction of the sheet.

7. The printing apparatus according to claim 1, wherein the guide unit is turnable up to a position at which the guide unit comes into contact with the roll sheet by being pushed by the sheet discharged from the discharge unit.

8. The printing apparatus according to claim 7, wherein a portion of the guide unit which comes into contact with the roll sheet has a roller member configured to rotate, following rotation of the roll sheet.

9. The printing apparatus according to claim 1, wherein a surface of the guide unit which faces the sheet is provided with one or more ribs aligned in a width direction of the sheet and extending along a discharging direction of the sheet discharged from the discharge unit.

10. The printing apparatus according to claim 1, wherein the guide unit has a guide portion extending upstream of a turning center of the turning unit in a discharging direction of the sheet, and in a state in which the guide unit turns when the sheet discharged from the discharge unit pushes a side of the guide unit downstream of the turning center in the discharging direction of the sheet, the guide portion protrudes from a surface of the guide unit, which guides the sheet, in a direction in which the guide portion pushes out the sheet.

11. The printing apparatus according to claim 1, wherein the guide unit includes a first guide portion and a second guide portion located below the first guide portion, the second guide portion is turnably connected to the first guide portion, the first guide portion is turnably supported by a support member extending in a width direction of the sheet, and the second guide portion is present at a position which allows the second guide portion to prevent the sheet from entering the feeding unit, and turns when the sheet discharged from the discharge unit pushes the second guide portion.

12. The printing apparatus according to claim 1, wherein the storage unit includes a flexible receiver in a sheet shape, and a rod supporting the receiver, and a storage space for the sheet discharged from the discharge unit is formed between the receiver and the feeding unit.

13. The printing apparatus according to claim 1, wherein a plurality of the feeding units are arranged at different positions in the gravity direction, and the storage unit is formed below the feeding unit located lowest among the plurality of feeding units.

14. A printing apparatus comprising:

a feeding unit comprising a nip arm and configured to support a roll sheet at a nip position of the nip arm and feed a sheet from the roll sheet;

a printing unit configured to perform printing on the sheet fed from the feeding unit;

a discharge unit arranged above the feeding unit and configured to discharge the sheet on which printing has been performed by the printing unit;

a storage unit partially arranged below the feeding unit and configured to store the sheet discharged from the discharge unit; and a guide unit arranged at a position different from the nip arm in a width direction of the sheet and configured to store the sheet discharged from the discharge unit, wherein the guide unit has a turning unit which prevents the sheet discharged from the discharge unit from entering the feeding unit and which turns when the sheet comes into contact with the turning unit, and wherein the position of a lower end of the guide unit in the horizontal direction is even with the position of the nip arm or forward of the position of the nip arm in the printing apparatus.

15. The printing apparatus according to claim 14, wherein a plurality of guide units are arranged along a width direction of the sheet.

16. The printing apparatus according to claim 4, wherein the position of the lower end of the guide unit in the gravity direction is the same height as or lower than the position of the nip position.

17. A printing apparatus comprising:

a feeding unit configured to support a roll sheet and feed a sheet from the roll sheet;

a printing unit configured to perform printing on the sheet fed from the feeding unit;

a discharge unit arranged above the feeding unit and configured to discharge the sheet on which printing has been performed by the printing unit;

a storage unit partially arranged below the feeding unit and configured to store the sheet discharged from the discharge unit; and a guide unit to guide the sheet discharged from the discharge unit toward the storage unit, wherein the guide unit has a first guide portion and a second guide portion located below the first guide portion, the second guide portion is turnably connected to the first guide portion, the first guide portion is detachably supported by a support member extending in a width direction of the sheet, and the second guide portion is present at a position which allows the second guide portion to prevent the sheet from entering the feeding unit, and turns when the sheet discharged from the discharge unit pushes the second guide portion.

18. The printing apparatus according to claim 17, wherein a plurality of guide units are arranged along the width direction of the sheet.

19. The printing apparatus according to claim 17, wherein the first guide portion is detached from the support member when a load greater than a specified load is exerted on the first guide portion.

* * * * *